United States Patent [19]

Tsuji et al.

[11] Patent Number: 4,502,899

[45] Date of Patent: Mar. 5, 1985

[54] ELECTRIC JOINT MATERIAL

[75] Inventors: Koji Tsuji, Osaka; Shuji Yamada, Kobe, both of Japan

[73] Assignee: Matsushita Electric Works, Ltd., Osaka, Japan

[21] Appl. No.: 390,944

[22] Filed: Jun. 22, 1982

[30] Foreign Application Priority Data

Jun. 30, 1981 [JP] Japan ..... 56-103032
Sep. 25, 1981 [JP] Japan ..... 56-152306

[51] Int. Cl.[3] ..... C22C 5/06; C22C 32/00
[52] U.S. Cl. ..... 148/431; 420/501
[58] Field of Search ..... 420/501, 502, 503–506; 148/431

[56] References Cited

U.S. PATENT DOCUMENTS 2,221,285 11/1940 Hensel et al. ..... 420/501

FOREIGN PATENT DOCUMENTS 13689 2/1977 Japan ..... 148/431
13690 2/1977 Japan ..... 148/431
30217 3/1977 Japan ..... 420/501
86463 7/1978 Japan ..... 148/431
81649 7/1981 Japan ..... 420/501
116845 9/1981 Japan ..... 148/431
119747 9/1981 Japan ..... 148/431
142837 11/1981 Japan ..... 148/431
156743 12/1981 Japan ..... 148/431
13134 1/1982 Japan ..... 148/431

*Primary Examiner*—L. Dewayne Rutledge
*Assistant Examiner*—Christopher W. Brody
*Attorney, Agent, or Firm*—Koda and Androlia

[57] ABSTRACT

A joint material that is improved in arc-proof characteristic, fusion-proof characteristic, and consumption-proof characteristic. The joint material contains silver, lithium oxide and one selected from the group consisting of aluminium oxide, calcium oxide, magnesium oxide, and silicon oxide. Furthermore, one selected from the group consisting of iron, nickel and cobalt may be contained as an additional component in the joint material. Such joint material is produced by a method of oxidizing the silver alloy containing lithium and one selected from the group consisting of aluminium, calcium, magnesium, and silicon, with the composition ratio of 0.1–3 wt % for lithium, and 0.01–1 wt % for aluminium, calcium, magnesium, and silicon, respectively, in quantitive conversion to metal or by a method of oxidizing the silver alloy containing, in addition to the components mentioned above, one selected from the group consisting of iron, nickel, and cobalt, with the composition ratio of 0.05–1 wt %. In either of those methods, the oxidization mentioned above is performed through internal oxidation in order to disperse each of the foregoing oxides in silver.

1 Claim, No Drawings

ELECTRIC JOINT MATERIAL

BACKGROUND OF THE INVENTION

1. Field of the Invention

The present invention relates to an electric joint material for an electric appliance and more particularly to an electric joint material containing silver as its primary component and a method for producing such an electric joint material.

2. Prior Art

Conventionally, electric joints produced from silver-cadomium oxide material (AgCdO), silver-tin oxide-system ($AgSnO_2$), and silver-nickel alloy (Ag—Ni) have been used for various electric apparatus and devices such as an electromagnetic contact, relay, etc. The AgCdO or $AgSnO_2$ system joint has been known as the joint having less fusion as well as consumption, and the Ag—Ni joint is known as the material which is less in consumption and high in workability.

However, such joints have had the problem that when they were used as the breaker joint of the type to cause an arc by means of the electromagnetic force during a short-circuit, and to split the arc by the grid to limit the electric current. In other words, because of the heavy electric current flowing during the short-circuit, the arc is caused, and the movability of this arc depends upon the joint material. The problem in the joint materials as mentioned above is that the movability of the arc is low, resulting in inferior short-circuit breakability.

Accordingly, for this type of breaker joint, it is necessary that the time between the occurrence of the arc and the entrance of the arc into the grid is short.

After repeatedly conducting various tests, the inventors found out that the joint material containing silver as the primary component with lithium oxide dispersed in the silver shows a remarkable effect in arc characteristic.

The arc stagnation time (arcing time) for the cases when various oxides are dispersed in silver is shown in Table 1. $Li_2O$ is rated best, followed by ZnO, $In_2O$, $Bi_2O_3$, in the order shown above, as seen in the Table 1.

TABLE 1

| CONTACT MATERIAL | | ARCING TIME (msec) |
|---|---|---|
| $AgLi_2O$ | (Li 1.5%) | 1.2 |
| AgZnO | (Zn 3%) | 1.5 |
| $AgIn_2O_3$ | (In 3%) | 1.5 |
| AgGeO | (Ge 3%) | 6.0 |
| $AgBi_2O_3$ | (Bi 0.5%) | 1.5 |
| $AgSiO_2$ | (Si 2.5%) | 2.1 |
| $AgSnO_2$ | (Sn 3%) | 2.9 |
| $AgMnO_2$ | (Mn 3%) | 2.6 |

(Short-circuit current 5.2KA)

However, when the foregoing $AgLi_2O$ joint material is obtained by first preparing a solid material by melting silver and lithium metal in an argon atmosphere, then by further processing this solid material with an internal oxidation method wherein the solid material is left in a high temperature and high pressure oxygen gas, the grain of lithium oxide becomes coarse, and such grains tend to cohere to the grain boundary of silver. As the result, the joint formed of such joint material has the problem that it is inferior in fusion characteristic as well as in consumption characteristic.

SUMMARY OF THE INVENTION

The present invention is intended to obviate the aforesaid disadvantages of the prior art.

The general object of the present invention is to provide a joint material that is improved in fusion characteristic and consumption characteristic, while maintaining the arc characteristic.

Another object of the present invention is to provide a method for producing such a joint material.

In keeping with the principles of the present invention, the objects are accomplished by a unique method of internally oxidizing a silver alloy containing silver as the primary component that in turn contains metallic lithium and one element selected from the group consisting of aluminium, calcium, magnesium, and silicon thereby providing a unique product. In this case, the product means a joint material wherein lithium oxide and one or not less than two types of oxides selected from the group consisting of aluminium oxide, calcium oxide, magnesium oxide, silicon oxide, are contained in silver.

DETAILED DESCRIPTION OF THE INVENTION

A detailed description will hereunder be given of the present invention.

First, the description begins with the silver alloy. This silver alloy is composed of silver as the primary component, with metallic lithium and one or not less than two types of the elements selected from the group consisting of aluminium, calcium, magnesium, and silicon, which are lesser in oxide formation free energy than the foregoing lithium (metallic lithium). The oxide forming free energies ($-\Delta F$) are shown below:

$Li_2O$: $469\times10^{-3}$ KJ/Kmol $Al_2O_3$: $1{,}425\times10^{-3}$ KJ/Kmol

CaO: $553\times10^{-3}$ KJ/Kmol

MgO: $516\times10^{-3}$ KJ/Kmol $SiO_2$: $733\times10^{-3}$ KJ/Kmol.

Every one of the oxides of Al, Ca, Mg, and Si is less in oxide formation free energy than lithium oxide.

Next, the description will be given on the internal oxidation of the silver alloy. The internal oxidation is carried out by heating the alloy at a high temperature for a long time in an oxygen gas atmosphere. The time factor is determined depending on the time limit required to reach the equilibrium state of the oxidizing reaction. This internal oxidation is completed by passing through several oxidizing reactions. That is, the oxygen which enters into the silver alloy first oxidizes the metallic element of the metal oxide which is less than lithium oxide in oxide formation free energy. Then the reaction to oxidize the metallic lithium begins. It means that the oxide of the metallic element that is oxidized first becomes the nucleus in the alloy, and around this nucleus, lithium oxide that is a product of the oxidizing reaction produced secondarily is deposited. Because the foregoing description of lithium oxide takes place at a large number of nuclei, the precipitates are fine, and also the grain boundary deposition is reduced. Therefore, the effect of improvement in consumption characteristic as well as in fusion characteristic is effected.

In addition to the effect to atomize lithium oxide as mentioned above, Al, Ca, Mg, and Si have the following effect. That is, when they are dispersed as oxides in silver, since all of these oxides are materials with high melting points (Table 2), they contribute to improve the weld-proof characteristic and the consumption-proof characteristic of the joint.

TABLE 2

| | MELTING POINT (C.°) | BOILING POINT (C.°) |
|---|---|---|
| $Al_2O_3$ | 2,053 | 2,980 |
| CaO | 2,587 | 3,500 |
| MgO | 2,800 | 3,600 |
| $SiO_2$ | 1,470–1,710 | 2,220–2,800 |

Furthermore, a description will be given on the composition ratio of the silver alloys composed of these metallic elements. For metallic lithium, 0.1–3% is preferable in percent by weight (hereinafter referred to simply as %). This range is because when the composition ratio is less than 0.1%, the break of the arc cannot be improved, without contributing to the arc characteristic, while at above 3%, the above-mentioned arc characteristic deteriorates. On the other hand, the metallic elements used together with this metallic lithium are effective even in micro-amount, and 0.01–1%, is appropriate for them as composition ratio. That is, at below 0.01%, the contribution to the improvement in consumption characteristic cannot be achieved, while at above 1%, the electric resistance increases, accompanied by a deterioration in fusion characteristic. It means that the fusion tends to occur easily between the joints, thereby impairing the effect of short-circuit breaking.

Moreover, the silver alloys wherein the iron group elements such as iron, cobalt, and nickel are further added to the above-mentioned metallic elements are also included in the silver alloys of the present invention. In such case, for the iron group element, 0.05–1% is appropriate as composition ratio to show the effects of curbing the grain growth due to the heating during the internal oxidation, and of the atomization of the crystal grain, thereby contributing to the improvement in fusion characteristic as well as in consumption characteristic. This range means that these iron group elements are ineffective in crystal grain atomization at below 0.05% in composition ratio, while at above 1%, they segregate to the grain boundary. Thus, in either case, they fail to contribute to the improvement in both fusion and consumption characteristics.

EXAMPLES

Hereunder, the objects and the effects of the present invention will be proved through reference to the examples and the comparison examples according to this invention.

Method for Producing the Joint Material

The joints according to the present invention were obtained by using the method of internal oxidation. Respective metals of silver, lithium, calcium, magnesium, aluminium, silicon, iron, nickel, and cobalt were weighed out according to the quantity specified for each of them in order to obtain the compositions listed in Table 3. Thereafter, they were melted by heating at about 1,300° C. in an argon gas atmosphere using a high frequency furnace. Then, by casting into the iron metal mold, a 12×18×70 mm ingot was obtained. In the nitrogen atmosphere, the annealing was carried out at 750° C., followed by the face cutting in order to remove the scales on the surface. After processing with the silver plate cladding and the rolling for facilitating the brazing, one mm sheet of material was obtained. It was further processed with extraction and forming, then, oxidized internally. For the internal oxidation, the heat treatment was performed at 750° C., at four atmospheres of pressure in an oxygen atmosphere, for 100 hours. In the argon gas atmosphere, the internally oxidized samples were brazed to copper rivets at 750° C. to obtain the ASTM test samples. Also, by brazing to copper base metals, the short-circuit test samples were prepared.

After the internal oxidation, the section of the samples was observed by using a metal microscope in order to confirm the completion of the internal oxidation as well as the formation of the oxide grains from the solute metals.

Evaluation of the Arc Characteristic

Through conducting short-circuit test using a current-limiting type breaker, the arcing time was measured.

In this case, the arcing time serves as the index of the short-circuit breakability, that was measured in the form of the variation in voltage of the arc caused by the short-circuit, after forming the joints from the test pieces by using them as the material for the breaker joints. To describe practically in this case, the arcing time is the time during which the arc caused between the joints stays without varying, and meantime, the arc travels due to the electromagnetic force generated with the arc caused. Consequently, the short-circuit breakability is meant to be improved when the arcing time is reduced.

The short-circuit current is 5.2 KA.

Evaluation of Consumption Characteristic and Fusion Characteristic

The tests were conducted in accordance with the ASTM (American Society for Testing Materials) test method that is representative in this type of test. The practical conditions for the test were set as follows:

Load: 100 V, 40 A, in A.C. current, single phase.

Contact Shape:

$\phi$=5 mm, flat (fixed contact), $\phi$=5 mm 12 R (movable contact), (herein $\phi$ is equal to the diameter).

Switching Frequency: 50,000 times, contact force 200 g, opening force 340 g

Number Tested: 3 Samples.

In the table shown below, the consumption is indicated by the mean value, while the fusion frequency is shown by the total sum of the frequency of the fusion which ocurred in three test pieces. The relative merit as a joint material is evaluated by means of the decrement in both consumption and weld frequency.

TABLE 3

| | | Composition (wt %) | Results: Arcing Time (m sec) | Fusion Frequency | Consumption (mg) | Vickers Hardness (100 g) |
|---|---|---|---|---|---|---|
| Example | 1 | 0.1Li—0.01Al—Ag | 2.0 | 30 | 26.4 | 65 |
| | 2 | 0.1Li—1Al—Ag | 2.1 | 57 | 9.4 | 140 |

TABLE 3-continued

| | | Composition (wt %) | Results: Arcing Time (m sec) | Fusion Frequency | Consumption (mg) | Vickers Hardness (100 g) |
|---|---|---|---|---|---|---|
| | 3 | 3Li—0.01Al—Ag | 2.0 | 81 | 34.0 | 120 |
| | 4 | 3Li—1Al—Ag | 3.5 | 85 | 35.0 | 145 |
| | 5 | 1Li—0.03Al—Ag | 1.1 | 0 | 4.3 | 82 |
| | 6 | 1Li—0.03Al—Ag | 1.2 | 8 | 5.9 | 87 |
| | 7 | 1Li—0.04Ca—Ag | 1.2 | 0 | 6.0 | 85 |
| | 8 | 1Li—0.4Ca—Ag | 1.3 | 7 | 5.4 | 92 |
| | 9 | 1Li—0.03Mg—Ag | 1.2 | 0 | 6.5 | 73 |
| | 10 | 1Li—0.3Mg—Ag | 1.1 | 5 | 10.0 | 85 |
| | 11 | 1Li—0.03Si—Ag | 1.2 | 1 | 13.5 | 105 |
| | 12 | 1Li—0.3Si—Ag | 1.1 | 6 | 11.0 | 120 |
| | 13 | 1Li—0.04Ca—0.2Fe—Ag | 1.1 | 0 | 5.4 | 89 |
| | 14 | 1Li—0.03Al—0.2Ni—Ag | 1.2 | 0 | 3.7 | 85 |
| | 15 | 1Li—0.03Mg—0.2Co—Ag | 1.2 | 0 | 6.0 | 75 |
| | 16 | 1Li—0.03Si—0.2Ni—Ag | 1.2 | 1 | 7.7 | 116 |
| Comparison Example | 1 | 1Li—Ag | 1.1 | 3 | 12.9 | 80 |
| | 2 | $SnO_2$—$In_2O_3$—Ag (MO 10%) | 7.6 | 8 | 3.7 | 128 |

It should be apparent to those skilled in the art that the above-described embodiments are merely illustrative of but a few of the many possible specific embodiments which represent the application of the principles of the present invention. Numerous and varied other arrangements can be readily devised by those skilled in the art without departing from the spirit and scope of the invention.

We claim:

1. Joint material consisting of silver, 0.1 to 3 wt. % of lithium which is dispersed as an oxide in said silver, 0.01 to 1 wt. % of one selected from the group consisting of aluminium, calcium, magnesium and silicon which is dispersed as an oxide in said silver and 0.05 to 1 wt. % of one selected from the group consisting of iron, nickel and cobalt.

* * * * *